US005586357A

United States Patent [19]

Kosakowski et al.

[11] Patent Number: 5,586,357

[45] Date of Patent: Dec. 24, 1996

[54] HAND-HELD SCRATCH TICKET SCRAPER

[76] Inventors: Steven J. Kosakowski, 125 R Baldwinville Rd, Winchendon, Mass. 01475; Brian A. Chipman, 151 Hosley Rd., Gardner, Mass. 01440

[21] Appl. No.: 501,419

[22] Filed: Jul. 10, 1995

[51] Int. Cl.[6] ..... A47L 13/022

[52] U.S. Cl. ..... 15/111; 15/236.01; 15/236.06; 15/236.08; 15/160; 30/169; D4/118; D32/42

[58] Field of Search ..... 15/111, 160, 236.01, 15/236.05, 236.06, 236.07, 236.08, 236.09; D32/42, 46, 48, 49; D4/118; 30/169

[56] References Cited

U.S. PATENT DOCUMENTS

| | | | |
|---|---|---|---|
| D. 290,056 | 5/1987 | Hatfield | D32/46 |
| D. 293,266 | 12/1987 | Stanich | D32/49 |
| 552,462 | 12/1895 | Beiser | 15/105 |
| 1,209,927 | 12/1916 | Bailey | 15/236.01 |
| 1,367,032 | 2/1921 | Ferdon | 15/236.01 |
| 1,841,163 | 1/1932 | Trane | 15/236.01 |
| 2,524,475 | 10/1950 | Renz | 15/105 |
| 2,817,864 | 12/1957 | Morton | 15/236.01 |
| 2,857,608 | 10/1958 | Schwartz | 15/111 |
| 3,274,684 | 9/1966 | Marks | 15/236.05 |
| 3,447,171 | 6/1969 | Eyer | 15/236.01 |
| 4,248,660 | 2/1981 | Johnson | 15/236.01 |
| 4,654,923 | 4/1987 | Faciane | 15/236.01 |
| 4,757,567 | 7/1988 | Booker | 15/236.01 |
| 4,777,693 | 10/1988 | Diba | 15/111 |
| 5,114,146 | 5/1992 | Booker | 15/236.07 |
| 5,143,371 | 9/1992 | Strahan | 15/236.08 |

FOREIGN PATENT DOCUMENTS

| | | | |
|---|---|---|---|
| 331025 | 12/1920 | Germany | 15/236.01 |
| 126052 | 9/1949 | Sweden | 15/236.07 |

*Primary Examiner*—David Scherbel
*Assistant Examiner*—Randall E. Chin
*Attorney, Agent, or Firm*—Karen A. Jalbert

[57] ABSTRACT

A scraper for precisely scraping a row of covering off a typical lottery game scratch ticket that has rows of game-determining indicia hidden by the removable covering. The scraper has a main body with an arcuate protruding appendage that has a blunt front end. In one embodiment, the rear end of the main body has bristles for brushing off ticket scrapings. In another embodiment, the scraper has a clip for storing winning tickets as well as the scraper itself. In yet another embodiment, the scraper has two or three appendages spaced apart so as to accurately scrape off the covering of the rows of game-determining indicia.

20 Claims, 2 Drawing Sheets

HAND-HELD SCRATCH TICKET SCRAPER

FIELD OF THE INVENTION

The present invention relates generally to a scraper for removing the covering of instant lottery game scratch tickets, and more particularly to a hand-held scraper with the ability to precisely remove distinct rows of the covering of instant lottery game scratch tickets.

BACKGROUND OF THE INVENTION

An instant lottery game ticket is generally comprised of a flat printed cardboard backer and a removable covering. The removable covering conceals the game outcome(s) and prizes(s). A "player" must remove, i.e. scrape-off, the covering to reveal the game outcome(s) and prize(s). Presently, the devices used to remove the covering are primarily a coin or a fingernail.

The devices described above are generally defective in design for this application as they are typically irregular in shape and radiused, creating inconsistent contact and thereby impeding the player's ability to effectively remove the covering precisely as desired.

More specifically, the devices described above are lacking as their use as a lottery scratch ticket scraper is not their primary or only use. Often times a player wishing to use a coin must rummage for the coin and may not find one readily available. A player who selects a fingernail is inconvenienced in that the covering of the instant lottery game ticket often lodges between the fingernail and the player's finger creating an unsightly appearance or potentially breaking the nail or blemishing a manicure.

There are certainly other devices that may be used to remove the covering of instant lottery game tickets. These devices and the current art of scrapers are generally lacking for this use due to their size—often too large, their shape—often too cumbersome, their efficacy—inadvertent removal of the "void if removed" section or damaging the cardboard backer.

SUMMARY OF THE INVENTION

It is therefore the primary objective of the present invention to provide a hand-held scraper for precisely removing the covering of instant lottery game scratch tickets.

The foregoing objective of the present invention is accomplished by a scraper, which comprises a main body with a protruding appendage. The main body is formed to comfortably rest between the thumb and fore-finger. The protruding appendage extends out from the main body slendering to a blunt end. The protruding appendage is designed to allow the player to easily view the specific area of the instant lottery game ticket being scraped. The blunt end of the protruding appendage is designed to effectively remove the covering of an instant lottery game ticket in a precise manner. These and other objects and features of the present invention will be apparent from the following description taken in conjunction with the accompanying drawings, in which like reference characters designate the same or similar parts throughout the figures thereof.

DETAILED DESCRIPTION OF THE INVENTION

With reference now to the drawings, and in particular to FIGS. 1 to 7 thereof, a hand-held lottery game ticket scraper embodying the principles and concepts of the present invention will now be described. The scraper is intended to be used in conjunction with a typical lottery scratch ticket which has rows of game-determining indicia hidden by a covering which is removable by scratching or scraping.

Figure 1:
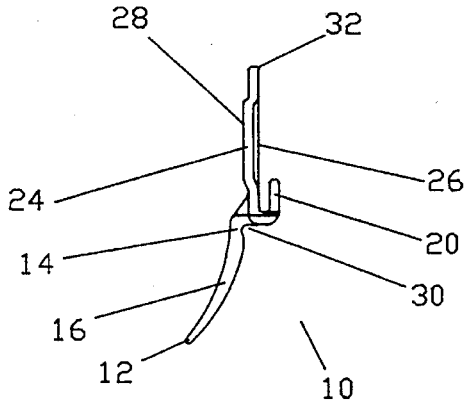
FIG. 1 shows a side view of a first preferred embodiment of the present invention.
Figure 2:
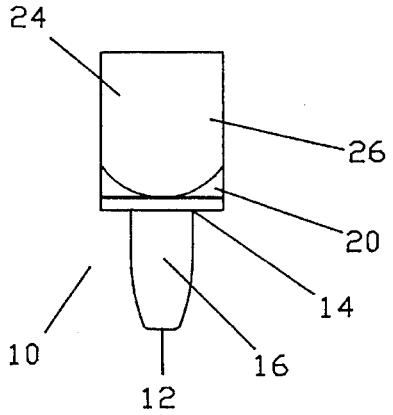
FIG. 2 shows a top view of a first preferred embodiment of the present invention.

Referring now to the drawings, reference numeral 10 in FIGS. 1 and 2 generally identifies a hand-held lottery game ticket scraper according to the first preferred embodiment of the present invention. The scraper 10 is shown to comprise a main body 24 and a protruding appendage 16. The main body 24 has a front end 30 and a rear end 32. The main body 24 further has an upper side 26 and a lower side 28. The upper side 26 may define an area for a user to place his thumb and the lower side 28 may define an area for a user to place his forefinger.

Extending from the front end 30 of the main body 24 is the appendage 16. The appendage 16 has an attached end 14 attached to the front end 30 of the main body and a scraping end 12. From the attached end 14 to the scraping end 12, the appendage comprises an arcuate strip of material having a radius of curvature between 20 mm and 60 mm and preferably a radius of curvature of 30 mm. The arcuate nature of the appendage 16 allows the main body 24 of the scraper 10 to be held in a substantially horizontal position while the scraping end 12 is in contact with the scratch ticket.

Contrary to the prior art, and as may be clearly seen in FIG. 2, the scraping end 12 is blunt. The blunt nature of the scraping end 12 provides for even scraping of the planar surface of a lottery ticket. Furthermore, the scraping end 12 may have a width of 2 mm to 10 mm and preferably a width of 4 mm. Such a width in this range corresponds to the width of a row of indicia on a lottery scratch ticket. Thus, the scraping end 12, when in contact with and moved across a scratch ticket, will precisely remove the covering off a row of indicia on the scratch ticket.

The appendage 16 is tapered in width from the attached end 14 to the scraping end 12. The greater width at the attached end 14 provides a larger and therefore stronger connection area to the main body 24 to prevent the appendage 16 from snapping off the main body 24 during scraping. The tapered width from the attached end 14 to the scraping end 12 allows the user to easily view the specific area of the scratch ticket being scraped.

Providing further strength to the appendage 16, the cross-sectional area of the appendage 16 may be substantially crescent-shaped, as may be clearly seen in FIG. 1. With the greatest thickness of the appendage 16 at the point of maximum flexing, the appendage 16 is provided with sufficient strength to prevent breakage during normal use.

The main body 24 is further provided with a raised support 20 at the front end 30. The raised support 20 extends a small distance above the upper side 26 of the main body 24 and extends between appendage 16 and from end 30 of main body 24. The raised support 20 provides an area for the user to apply a force substantially horizontal to the planar surface of the scratch ticket. The raised support 20, as shown in FIG. 2 may be provided with a curved wall to conform to the user's thumb. The raised support 20 may be a separate extension from the front end 30 of the main body 24, as shown in FIG. 1 to decrease the cost of the scraper by employing less material. Alternatively, the raised support 20 may be a solid structure, i.e. a solid block of material extending from upper side 26, to increase the sturdiness of the area surrounding the front end 30 and attached end 14.

The scraper 10 may be made from plastic, metal, wood, or any other material with sufficient strength. A simple, cost-efficient method of manufacture would be for the scraper 10, or parts thereof, to be made from an injection molded plastic. When the appendage 16 is made from plastic, the covering of the lottery ticket will tend to ball up at the scraping end 12 during scraping. This prevents a substantial amount of the scrapings from spreading across the remaining surface of the scratch ticket, and thereby allows the scrapings to be neatly removed.

Figure 3:
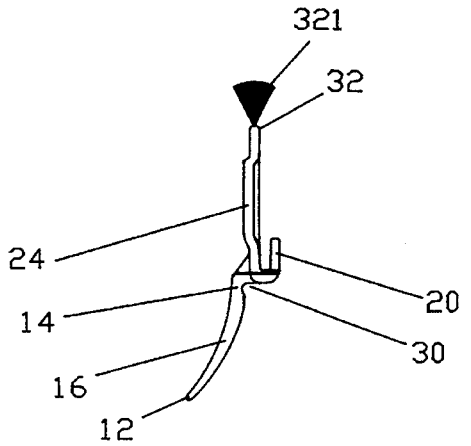
FIG. 3 shows a side view of a second preferred embodiment of the present invention.
Figure 4:
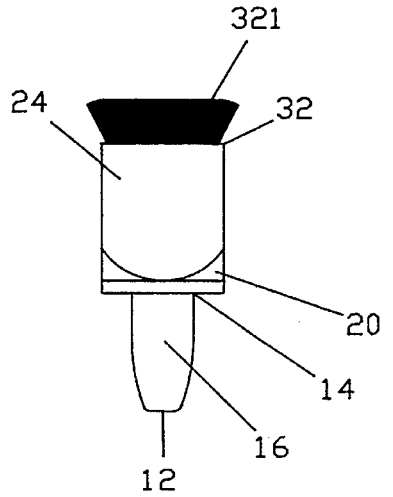
FIG. 4 shows a top view of a second preferred embodiment of the present invention.

Although the majority of the scrapings may be balled up at the scraping end 12 of a plastic appendage 16, stray particles may still remain which would need to be cleared off. Also, in the event that another material besides plastic were used for the appendage, the pieces of the removed covering would need to be cleared off from the ticket. Therefore, as shown in FIGS. 3 and 4, the second preferred embodiment of the present invention is provided with a main body 24 which has bristles 321 extending from the rear end 32 and substantially along the same plane as the main body 24. It is important that the bristles 321 do not fall far below the plane of the main body 24, otherwise, inadvertent scratching of the ticket may occur. The bristles 321 may be made from any flexible, semi-rigid strands of material and may be used for sweeping off any particles of removed covering lying on a ticket.

Figure 5:
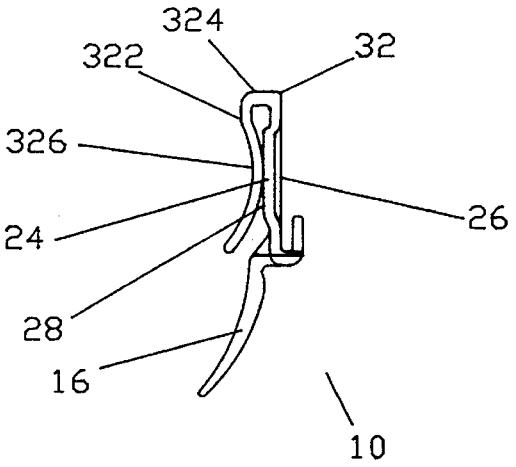
FIG. 5 shows a side view of a third preferred embodiment of the present invention.

Because the scraper 10 is relatively small in size, it may become easily misplaced. Also, since many lottery game players purchase several tickets at the same time, the unscratched tickets or the remaining winning tickets need to be held together in the same location to prevent unfortunate losses. Therefore, to solve both these problems, the third preferred embodiment of the present invention, as illustrated in FIG. 5, is shown to have a clip 322 extending from the rear end 32 of the main body 24. The clip 322 may have a first portion 324 perpendicularly attached to the rear end 32 and a second arcuate portion 326 attached to the first portion 324. The second arcuate portion 326 is curved so that the lower side 28 of the main body 24 is tangential to the second arcuate portion 326, defining a closed position in which the clip 322 is biased. The clip 322 is in an open position when the second arcuate portion 326 is separated from the lower side 28. In this open position, the scraper 10 may be placed on a visor of a car, some pages of a planner, or anywhere else where the user may easily access the scraper 10 once tickets are purchased. Alternatively, winning tickets may be held together by sliding them between the second arcuate portion 326 and the lower side 28 of the main body 24. Of course, the user would also have the option of holding the tickets together and storing the scraper in a convenient location at the same time.

Figure 6:
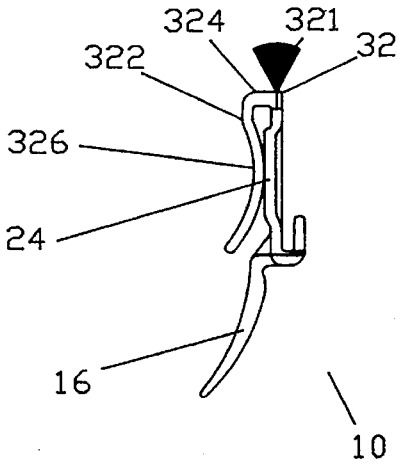
FIG. 6 shows a side view of a fourth preferred embodiment of the present invention.

As illustrated in FIG. 6, the fourth preferred embodiment of the present invention demonstrates that the options described in reference to the second and third embodiments may be combined. In other words, the main body 24 having a rear end 32 may have both bristles 321 and a clip 322 as previously described.

In operation, the scraper 10 is used to scrape the covering off a lottery game scratch ticket. A user of the scraper 10 would place his thumb on the upper side 26 of the main body 24 and his forefinger on the lower side 28 of the main body 24 to hold the scraper 10 between his thumb and forefinger. The user would then place the blunt scraping end 12 of the appendage 16 on the ticket. The user would then use his thumb to apply a force against the wall of the raised support 20. In use, the main body 24 of the scraper 10 is parallel to the planar surface of the ticket for comfort. The curvature, size, and shape of the appendage allows the user to view the area of the ticket to be scraped. The force applied to the raised support 20 by the user's thumb causes the scraping end 12 to move across the surface of the ticket, thus removing the covering off the ticket and revealing the game-determining indicia. The user can then dispose of any balled up covering lying on the scraping end. Any remaining particles can be removed by sweeping the bristles 321 across the ticket. After the user finishes scraping all his scratch tickets, he may keep the winning tickets in one area by clipping them together and to the scraper 10 with the clip 322. The user may also clip the scraper 10 to a convenient location using the clip 322.

Figure 7:
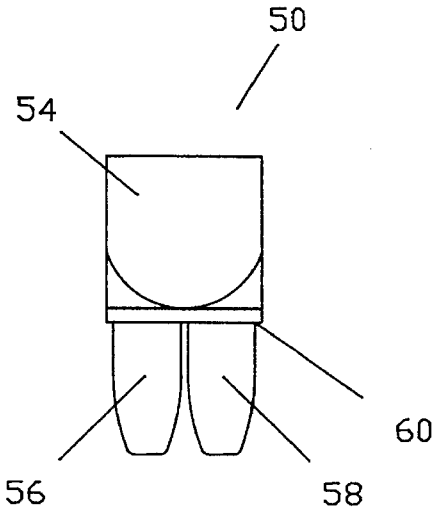
FIG. 7 shows a top view of the fifth preferred embodiment of the present invention.

A fifth preferred embodiment of the present invention is for the truly ambitious lottery game players. As illustrated in FIG. 7, a lottery game ticket scraper 50 may have a main body 54 which is wider than main body 24 of scraper 10. The front end 60 of main body 54 is provided with two separate appendages 56 and 58. Appendages 56 and 58 are spaced apart at a distance corresponding to the distance between two rows of indicia on a scratch ticket. Each appendage 56 and 58 has a scraping end which corresponds to the width of a single row of indicia on a scratch ticket, and has a side view as shown in FIG. 1. Therefore, a user employing scraper 50 may scrape off two rows of covered indicia simultaneously. In another embodiment, a scraper may have a third appendage to allow a user to scrape off three rows of covered indicia simultaneously. Of course, scraper 50 may be provided with bristles 321, or clip 322, or both.

The embodiments of the present invention described above are to be regarded in all respects as merely illustrative and not restrictive. Accordingly, the present invention may be embodied in other specific forms without deviating from the spirits thereof. The present invention is therefore to be limited only by the scope of the following appended claims.

What is claimed is:

1. A lottery game scratch ticket scraper for use with a lottery game scratch ticket of the type having a planar surface with rows of indicia hidden by a removable covering, said scraper comprising:

a planar main body, said main body having a planar upper side defining a thumb lying area and a lower side defining a forefinger lying area, said main body further having a front end and a rear end;

at least one appendage protruding from said main body, said at least one appendage comprising an arcuate strip of material which lies outside the plane defined by said planar main body, said arcuate strip of material having a crescent-shaped cross-sectional shape for preventing breakage, wherein said at least one appendage has an attached end and a scraping end, said attached end being attached to said front end of said main body and said scraping end for scraping the covering off a lottery game scratch ticket and said scraper further comprising a brush means attached to said rear end of said main body for brushing off game ticket covering scrapings wherein said brush means comprises bristles extending substantially in the same plane as said planar main body.

2. The lottery game scratch ticket scraper of claim 1 wherein said at least one appendage is made of a plastic material so that the covering from a lottery game ticket will ball up at said scraping end when said scraping end is moved across the ticket and wherein said main body and said at least one appendage are formed unitarily of plastic through injection molding.

3. The lottery game scratch ticket scraper of claim 1 wherein said at least one appendage is tapered in width from said attached end to said scraping end so that said attached end has a strong connection with said front end to prevent said at least one appendage from snapping off said main body during use and wherein said scraping end has a width corresponding to the width of a row of indicia.

4. The lottery game scratch ticket scraper of claim 3 wherein said scraping end has a width of 4 mm and said attached end has a width of 10 mm in order to allow a user to view the surface of the lottery ticket while it is being scraped.

5. The lottery game scratch ticket scraper of claim 3 further comprising a raised support extending above said upper side and between said at least one appendage and said front end of said main body so that a user may apply a force against said support and parallel to the planar surface of a lottery ticket, said raised support having a curved wall to conform to a user's thumb.

6. The lottery game scratch ticket scraper of claim 5 further comprising a clip means attached to said main body.

7. The lottery game scratch ticket scraper of claim 1 further comprising a clip means attached to said main body.

8. The lottery game scratch ticket scraper of claim 7 wherein said clip means comprises an attached section attached perpendicularly to said rear end of said main body and an arcuate section arched towards said lower side of said main body wherein said clip means is biased in a closed position with said arcuate section in contact with said lower side of said main body.

9. A lottery kit comprising:

a lottery game scratch ticket of the type having a planar surface with rows of indicia hidden by a removable covering, and a lottery game scratch ticket scraper for scraping the lottery game scratch ticket, wherein said scraper comprises a main body, said main body having an upper side and a lower side, said main body further having a front end and a rear end, said scraper further comprises at least one arcuate appendage protruding from said main body wherein said at least one appendage has an attached end and a blunt scraping end, said attached end being attached to said front end of said main body and said scraping end for scraping the covering off the lottery game scratch ticket, wherein said appendage is tapered in width from said attached end to said scraping end, said scraping end having a width corresponding to the width of a single row of indicia on said lottery game scratch ticket, and further wherein said appendage comprises a curved strip of material having a radius of curvature such that when said scraping end is placed on the lottery game scratch ticket, said main body is parallel to said planar surface of said lottery game Scratch ticket.

10. The kit of claim 9 further comprising a raised support extending above said upper side and between said at least one appendage and said front end of said main body so that a user may apply a force against said support and parallel to the planar surface of the lottery ticket, said raised support having a curved wall to conform to a user's thumb.

11. The kit of claim 10 further comprising a clip means attached to said lower side of said main body for storing said lottery game scratch ticket.

12. The kit of claim 11 wherein said main body, said at least one appendage, said raised support, and said clip means are formed unitarily in plastic through injection molding.

13. The kit of claim 9 further comprising a clip means attached to said lower side of said main body for storing said lottery game scratch ticket.

14. The kit of claim 9 further comprising a brush means attached to said rear end of said main body for brushing off covering scrapings wherein said brush means comprises bristles extending substantially in the same plane defined by the plane of said main body so that when said scraping end is on said lottery game scratch ticket in a scraping position, said bristles are substantially parallel to said planar surface of said lottery game scratch ticket.

15. A lottery game scratch ticket scraper for use with a lottery game scratch ticket of the type having a planar surface with rows of indicia hidden by a removeable covering, said scraper comprising:

a planar main body, said main body having a planar upper side defining a thumb lying area and a lower side defining a forefinger lying area, said main body further having a front end and a rear end;

at least one appendage protruding from said main body, said at least one appendage comprising an arcuate strip of material which lies outside the plane defined by said planar main body, said arcuate strip of material having a crescent-shaped cross-sectional shape for preventing breakage, wherein said at least one appendage has an attached end and a scraping end, said attached end being attached to said from end of said main body and said scraping end for scraping the covering off a lottery game scratch ticket and said scraper further comprising clip means attached to said main body.

16. The lottery game scratch ticket scraper of claim 15 further comprising a brush means attached to said rear end of said main body for brushing off game ticket covering scrapings wherein said brush means comprises bristles extending substantially in the same plane as said planar main body.

17. The lottery game scratch ticket scraper of claim 15 further comprising a raised support extending above said upper side and between said at least one appendage and said front end of said main body so that a user may apply a force against said support and parallel to the planar surface of a lottery ticket, said raised support having a curved wall to conform to a user's thumb.

18. The lottery game scratch ticket scraper of claim 15 wherein said scraper has a single appendage centered at said front end of said main body.

19. The lottery game scratch ticket scraper of claim 15 wherein said scraper has two appendages with scraping ends separated by a distance corresponding to the distance between two rows of indicia on a lottery game scratch ticket.

20. The lottery game scratch ticket scraper of claim 15 wherein said clip means comprises an attached section attached perpendicularly to said rear end of said main body and an arcuate section arched towards said lower side of said main body wherein said clip means is biased in a closed position with said arcuate section in contact with said lower side of said main body.

* * * * *